US009738080B1

(12) United States Patent
Harvey et al.

(10) Patent No.: US 9,738,080 B1
(45) **Date of Patent: *Aug. 22, 2017**

(54) FLUID CARTRIDGE

(71) Applicant: HEWLETT-PACKARD DEVELOPMENT COMPANY, L.P., Houston, TX (US)

(72) Inventors: David C. Harvey, Portland, OR (US); Curt Gonzales, Corvallis, OR (US); Ralph L. Stathem, Lebanon, OR (US); David Olsen, Corvallis, OR (US); David Welter, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/581,394

(22) Filed: Apr. 28, 2017

Related U.S. Application Data

(63) Continuation of application No. 15/372,896, filed on Dec. 8, 2016, which is a continuation of application (Continued)

(51) Int. Cl.
*B41J 2/175* (2006.01)

(52) U.S. Cl.
CPC ..... *B41J 2/17503* (2013.01); *B41J 2/1752* (2013.01); *B41J 2/17526* (2013.01); *B41J 2/17553* (2013.01); *B41J 2/17543* (2013.01)

(58) Field of Classification Search
CPC .. B41J 2/17503; B41J 2/17553; B41J 2/1752; B41J 2/17526; B41J 2/17543
See application file for complete search history.

(56) References Cited

U.S. PATENT DOCUMENTS 3,697,103 A 10/1972 Mostyn
5,273,328 A 12/1993 Kurosaki
(Continued)

FOREIGN PATENT DOCUMENTS

CN 1186021 A 7/1998
CN 1243064 A 2/2000
(Continued)

OTHER PUBLICATIONS

Machine generated English translation of JP08-169121A to Wada Yasuhiro, "Ink Cartridge Replacing Mechanism"; (cont. from above) generated via http://www19.ipdl.inpit.go.jp/PA1/cgi-bin/PA1INDEX on May 10, 2013; 4 pp.
(Continued)

*Primary Examiner* — Manish S Shah
*Assistant Examiner* — Yaovi M Ameh
(74) *Attorney, Agent, or Firm* — HP Inc. Patent Department

(57) ABSTRACT

An ink cartridge for an inkjet printer includes a bottom face and a front face; an ink interface on the front face of the ink cartridge for connection to a cartridge receiving structure; a guide interface in the bottom face for guiding the cartridge along a straight line during insertion into the cartridge receiving structure for connecting the ink interface; a latch track disposed in the bottom face of the ink cartridge to guide a latch of the cartridge receiving structure; a latch stop disposed in the latch track for engage ng the latch, where the latch track comprises a locking track and an unlocking track to accommodate movement of the latch with respect to the latch stop, the locking track being at least partly separate from the unlocking track; and a latch guide for redirecting the latch towards the locking track, rather than the unlocking track.

30 Claims, 10 Drawing Sheets

Related U.S. Application Data

No. 14/675,362, filed on Mar. 31, 2015, now Pat. No. 9,616,670, which is a continuation of application No. 14/063,713, filed on Oct. 25, 2013, now Pat. No. 9,028,054, which is a continuation of application No. 13/765,455, filed on Feb. 12, 2013, now Pat. No. 8,651,643, which is a continuation of application No. PCT/US2010/053692, filed on Oct. 22, 2010.

(56) References Cited

U.S. PATENT DOCUMENTS

| | | | |
|---|---|---|---|
| 5,512,926 | A | 4/1996 | Uchikata |
| 6,056,333 | A | 5/2000 | Wach |
| 6,168,262 | B1 | 1/2001 | Clark |
| 6,213,454 | B1 | 4/2001 | Bivens |
| 6,494,630 | B2 | 12/2002 | Williams |
| 6,959,985 | B2 | 11/2005 | Steinmetz |
| 6,962,408 | B2 | 11/2005 | Steinmetz |
| 6,993,801 | B2 | 2/2006 | Marko |
| 7,004,564 | B2 | 2/2006 | Steinmetz |
| 7,090,343 | B2 | 8/2006 | Steinmetz |
| 7,114,801 | B2 | 10/2006 | Hall |
| 7,147,310 | B2 | 12/2006 | Steinmetz |
| 7,407,275 | B2 | 8/2008 | Inoue |
| 7,438,401 | B2 | 10/2008 | Seino |
| 7,506,973 | B2 | 3/2009 | Steinmetz |
| 7,744,202 | B2 | 6/2010 | Steinmetz |
| 8,474,960 | B1 | 7/2013 | Harvey |
| 8,534,814 | B2 | 9/2013 | Yazawa |
| 9,616,670 | B2 * | 4/2017 | Harvey ..... B41J 2/1752 |
| 2001/0010532 | A1 | 8/2001 | Battey |
| 2002/0112878 | A1 | 8/2002 | Ishizawa |
| 2002/0158948 | A1 | 10/2002 | Miyazawa |
| 2002/0171251 | A1 | 11/2002 | Bieck |
| 2002/0196312 | A1 | 12/2002 | Ishizawa |
| 2003/0035035 | A1 | 2/2003 | Komplin |
| 2003/0184617 | A1 | 10/2003 | Jones |
| 2003/0184622 | A1 | 10/2003 | Sasaki |
| 2004/0021737 | A1 | 2/2004 | Harada |
| 2004/0027432 | A1 | 2/2004 | Childers |
| 2004/0104984 | A1 | 6/2004 | Hall |
| 2005/0052511 | A1 | 3/2005 | Seino |
| 2005/0088497 | A1 | 4/2005 | Katayama |
| 2005/0116998 | A1 | 6/2005 | Kazumasa |
| 2005/0146578 | A1 | 7/2005 | Takagi |
| 2007/0013753 | A1 | 1/2007 | Steinmetz |
| 2007/0070156 | A1 | 3/2007 | Steinmetz |
| 2008/0168481 | A1 | 7/2008 | Ching-Long |
| 2008/0198210 | A1 | 8/2008 | Umeda |
| 2008/0239036 | A1 | 10/2008 | Hattori |
| 2008/0284810 | A1 | 11/2008 | Shimizu |
| 2009/0179969 | A1 | 7/2009 | Hibbard |
| 2009/0244224 | A1 | 10/2009 | Koizumi |
| 2010/0171799 | A1 | 7/2010 | Takeuchi |
| 2010/0208013 | A1 | 8/2010 | Zaba |
| 2010/0225704 | A1 | 9/2010 | Aoki |
| 2010/0231664 | A1 | 9/2010 | Steinmetz |
| 2011/0057997 | A1 | 3/2011 | Takeuchi |
| 2011/0102523 | A1 | 5/2011 | Chen |
| 2011/0136360 | A1 | 6/2011 | Zhu |

FOREIGN PATENT DOCUMENTS

| | | | |
|---|---|---|---|
| CN | 1349894 | A | 5/2002 |
| CN | 1860031 | A | 11/2006 |
| CN | 101143519 | A | 3/2008 |
| EP | 0789322 | A2 | 8/1997 |
| EP | 0885730 | | 12/1998 |
| EP | 1122078 | A2 | 8/2001 |
| EP | 1219448 | A2 | 7/2002 |
| EP | 1815994 | A2 | 8/2007 |
| ER | 1348562 | A2 | 10/2003 |
| GB | 2316657 | A | 4/1998 |
| JP | 08169121 | A | 7/1996 |
| JP | 2001-277541 | | 10/2001 |
| JP | 2003-025608 | A | 1/2003 |
| JP | 2004074553 | A | 3/2004 |
| JP | 2004-167795 | A | 6/2004 |
| JP | 2006043922 | A | 2/2006 |
| JP | 2007-098958 | A | 4/2007 |
| JP | 2008-132797 | | 6/2008 |
| JP | 2008-183783 | A | 8/2008 |
| JP | 2008-213147 | A | 9/2008 |
| JP | 2009234031 | A | 10/2009 |
| KR | 10-1998-0070824 | | 10/1998 |
| KR | 10-2007-0072450 | | 7/2007 |
| KR | 10-2008-0022000 | A | 3/2008 |
| TW | 495444 | B | 7/2002 |
| TW | 505573 | B | 10/2002 |
| WO | WO-9855318 | A1 | 12/1998 |
| WO | WO-0154910 | A2 | 8/2001 |
| WO | WO-2009139763 | A1 | 11/2009 |
| WO | WO-2010134907 | A1 | 11/2010 |

OTHER PUBLICATIONS

Office Action dated Jul. 15, 2014 issued in U.S. Appl. No. 14/063,713.

* cited by examiner

FLUID CARTRIDGE

RELATED APPLICATION

The present specification is a continuation of co-pending U.S. application Ser. No. 15/372,896 filed 8 Dec. 2016, which is a continuation of U.S. application Ser. No. 14/675,362 filed 31 Mar. 2015, which is a continuation of U.S. application Ser. No. 14/063,713, filed 25 Oct. 2013, which is a continuation of U.S. application Ser. No. 13/765,455, filed 12 Feb. 2013, which is a bypass continuation of PCT/US2010/053692, filed 22 Oct. 2010, entitled "FLUID CARTRIDGE," the contents of all above-named applications are incorporated herein by reference in their entirety.

BACKGROUND

Fluid cartridges are subassemblies to be exchanged with a corresponding fluid ejection assembly. A common fluid cartridge is an ink cartridge. A common fluid ejection assembly is a printer. In general, two types of ink cartridges can be distinguished. A first type consists of an integrated print head cartridge, wherein the cartridge comprises a print head. A second type consists of an individual ink container. An ink cartridge is connected to a receiving structure of a printer. The receiving structure and the ink cartridges are provided with the proper interfaces for guiding ink from the cartridge to the print head for printing. In addition to the ink interface, an air interface, a keying interface, an electrical interface and an alignment interface can be provided in the ink cartridge and its receiving structure. The air interface transports air to and from the cartridge, mostly for pressure control inside the cartridge. The keying interface ensures that the respective cartridge is seated in the proper ink cartridge receiving structure. The alignment interface ensures that the interfaces are well aligned for connection. The electrical interface sends electrical signals between a printer control circuit and the ink cartridge. The signals may relate to ink cartridge characteristics.

An extra lock is usually provided to maintain substantially air and liquid tight connections between the cartridge and the receiving structure. The extra lock should also maintain the electrical connection. A known locking technique involves the use of a bail to keep the cartridge sealed to the receiving bay. Another known locking technique uses a deforming snap finger that engages a notch to keep the cartridge sealed.

The known lock mechanisms tend to consume a relatively large amount of space within the printer. In addition, significant force may be needed to establish the lock. In some cases, the cartridge is inserted in an inclined orientation, after which it is rotated back to normal position to make the interfaces engage. This usually involves deflection of engaging elements so that improper interface connections, leakage, and material wear or damage are likely to occur.

BRIEF DESCRIPTION OF THE DRAWINGS

For the purpose of illustration, certain embodiments of the present invention will now be described with reference to the accompanying diagrammatic drawings, in which.

DETAILED DESCRIPTION

In the following detailed description, reference is made to the accompanying drawings. The embodiments in the description and drawings should be considered illustrative and are not to be considered as limiting to the specific embodiment or element described. Multiple embodiments may be derived from the following description and/or drawings through modification, combination or variation of certain elements. Furthermore, it may be understood that other embodiments or elements that are not literally disclosed may be derived from the description and drawings by a person skilled in the art.

In this description, reference may be made to a three dimensional space comprising an X, Y and Z-axis. The one dimensional insertion and ejection direction of the cartridge 3 is parallel to the Y-axis. The Y-axis is also referred to as a straight line Y.

Figure 1:
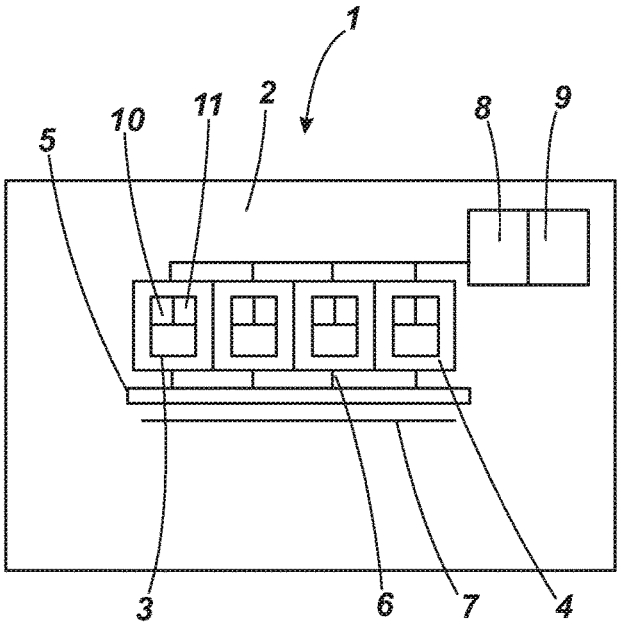
FIG. 1 illustrates a diagram of an embodiment of a fluid ejection system, in front view.
Figure 2:
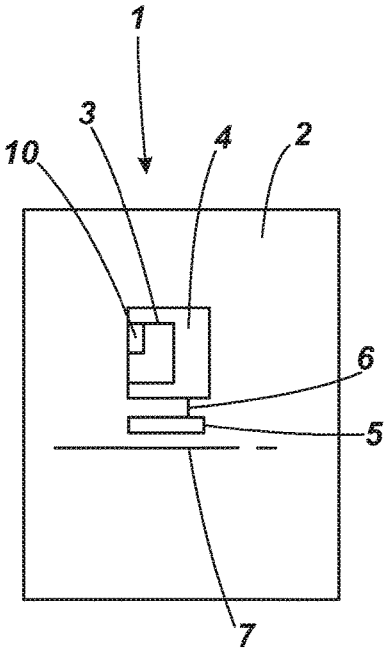
FIG. 2 illustrates a diagram of the embodiment of the fluid ejection system of FIG. 1, in side view.

FIGS. 1 and 2 show a fluid ejection system 1. The fluid ejection system 1 comprises a fluid ejection device 2 and fluid cartridges 3. The fluid ejection device 2 may comprise a printer. The printer may be an inkjet printer, for example a thermal inkjet, a piezo inkjet, or a continuous inkjet printer. The fluid ejection device 2 comprises one or more receiving structures 4 for receiving and exchanging one or more corresponding fluid cartridges 3. Each cartridge 3 of the same fluid ejection device 2 may comprise a different fluid. If the fluid ejection device 2 is a printer, the fluid in each cartridge 3 may comprise ink of a specific color, for example a cyan, magenta, yellow, black and/or grey. The cartridges 3 are arranged to be exchanged with respect to the respective receiving structure 4.

The receiving structures 4 are arranged to connect the cartridge 3 to the print head 5. A fluid supply 6 is provided to receive fluid from the respective cartridges 3, and deliver the fluid to the print head 5. In the shown embodiment, the receiving structures 4 and the cartridges 3, when installed, are arranged off axis. The print head 5 may comprise a page wide array print head (PWA) or a scanning print head. The receiving structure 4 is arranged to establish a fluidic interface between the cartridge 3 and the print head 5, through the fluid supply 6. During printing a print medium 7 extends under the print head 5. In other embodiments (not shown), the receiving structures 4 and the cartridges 3, when installed, are arranged on a scanning axis. In further embodiments, the cartridge 3 comprises an integrated print head, wherein the fluid volume and the print head are integrated into one cartridge supply to be connected to the receiving structure 4.

The fluid ejection device 2 is provided with a control circuit 8 and a memory 9. The fluid cartridge 3 is provided with a cartridge electrical circuit 10, for example including a cartridge memory 11. The control circuit 8 is arranged to retrieve data from the cartridge electrical circuit 10. The data comprises certain cartridge characteristics, for example product characteristics, fluid type characteristics and/or fluid quantity characteristics.

Figure 3:
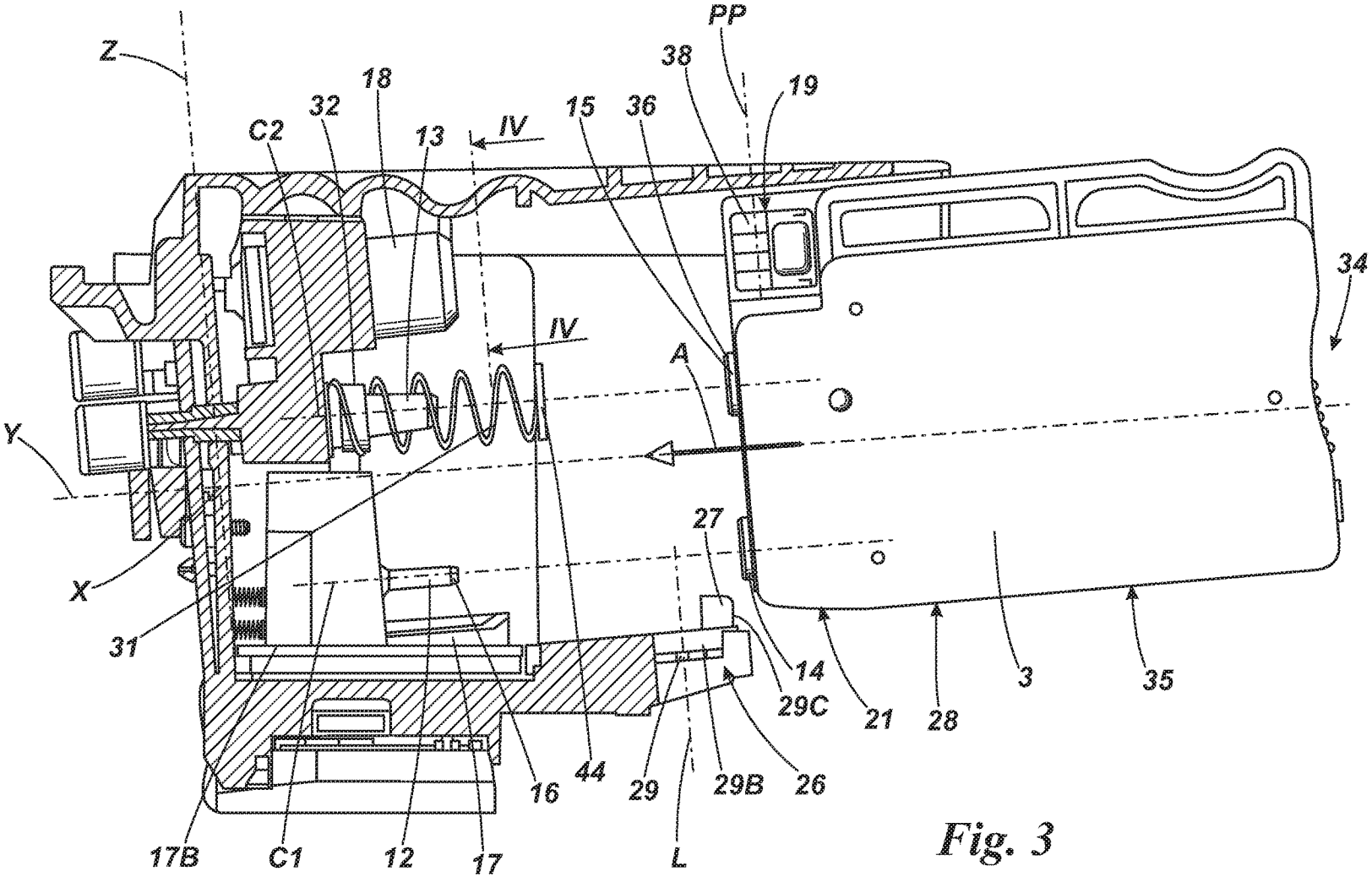
FIG. 3 illustrates a cross sectional side view of a part of an embodiment of a fluid ejection system with a fluid cartridge in a non-connected state.

FIG. 3 shows a receiving structure 4 and a fluid cartridge 3 in a position right before or after installation. At installation (FIG. 7), all interfaces of the receiving structure 4 and the fluid cartridge 3 are interconnected. The receiving structure 4 may comprise a slot shaped opening into which the cartridge 3 is inserted. A part of the receiving structure 4 may be arranged to guide the cartridge 3 into connection with the guide 17 for movement along straight line Y. The arrow A indicates an insertion movement of the cartridge 3, along the straight, one dimensional, line Y, represented by the Y-axis. Once the fluid cartridge 3 engages the guide 17, it's insertion movement is substantially confined to movement along the straight line Y. In principle, there is substantially no movement along a Z and X-axis and there is substantially no rotational movement of the cartridge 3, during insertion and ejection along the guide 17. However, the skilled person will understand that a certain amount of play, margin or tolerance in the interfacing materials of the cartridge 3 and receiving structure 4, such as the guide 17, may be allowed. In one embodiment, the margin of deviation is approximately 3 millimeters or less, in a direction perpendicular to the straight line Y, and approximately 3° or less around the straight line Y, or the Z-axis or X-axis. These margins may still allow proper connection of the cartridge 3 to the receiving structure 4.

The receiving structure 4 comprises two fluidic interfaces. The fluidic interfaces include one first fluid pen 12 and one second fluid pen 13. The first fluid may be a print fluid such as ink. The second fluid may be a gas such as air. The pens 12, 13 are arranged to establish a fluidic connection with corresponding first and second cartridge fluidic interfaces. The first and second cartridge fluidic interface may comprise a first and second socket 14, 15, respectively. The pens 12, 13 have central axes C1, C2, respectively, that are parallel to the Y-axis. In one embodiment (not shown), the receiving structure 4 has only one fluidic interface, for example a pen. In another embodiment (not shown), the receiving structure 4 has more than two such fluidic interfaces.

In an embodiment, the first fluid pen 12 comprises an ink pen. The first fluid pen 12 has a relatively small diameter at its mouth 16. The first fluid pen 12 has a longitudinal shape. The first fluid pen 12 has a truncated, conical shape. The first fluid pen 12 may be made of molded plastics. The receiving structure 4 comprises a guide 17 for guiding the cartridge 3 along the one dimensional direction Y at insertion and ejection. The guide 17 may be longer than the first fluid pen 12, or at least of approximately the same length, for proper insertion of the pen 12 in the corresponding socket 14, and to prevent breaking or bending the pen 12 at insertion or ejection. This allows the pen 12 to be made of relatively cheap molded plastics.

In an embodiment, the second fluid pen 13 comprises a gas interface for controlling a pressure in the inner volume of the fluid cartridge 3. The gas may comprise ambient air. In a further embodiment, the second fluid pen 13 is arranged to connect to the second socket shaped fluidic interface 15, which in turn may connect to a pressure bag in the inner volume of the cartridge 3. The second fluid pen 13 has a longitudinal shape. The second fluid pen 13 has a truncated, conical shape. The second fluid pen 13 may be made of molded plastics. The guide 17 may be longer than the second fluid pen 13, or at least of approximately the same length, for proper insertion of the second fluid pen 13 in the corresponding second fluidic interface 15, and to prevent breaking or bending the second fluid pen 13 at insertion or ejection. This allows the pen 13 to be made of relatively cheap molded plastics.

The guide 17 and/or the corresponding guide interface that confine the insertion and ejection movement of the cartridge 3 to one dimension. This allows relatively long and deep of the interfaces 12, 13 and 14, 15, respectively. The respective pen 12, 13 may have a length of at least 5 millimeter, or at least 10 millimeters. The corresponding socket 14, 15 may have a depth of at least approximately 3 millimeters, or at least approximately 5 millimeters, or approximately 10 millimeters.

Figure 4:
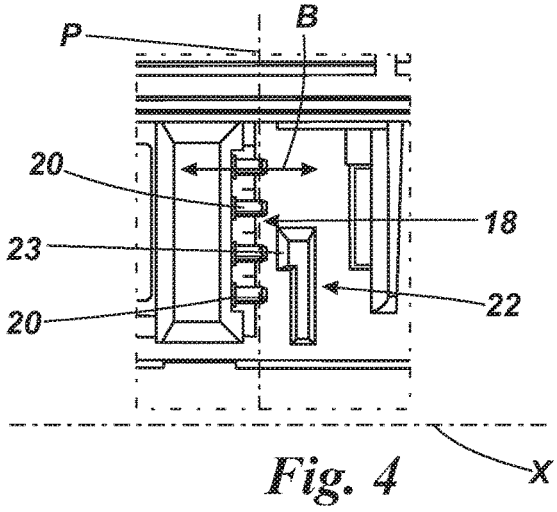
FIG. 4 illustrates an embodiment of a detail of a receiving structure for a fluid cartridge, in front view.

In an embodiment, the receiving structure 4 comprises a connector circuit 18 for interconnecting the control circuit 8 of the fluid ejection device 2 with the cartridge electrical circuit 19. In FIG. 3, the backside of the connector circuit 18 is shown. In FIG. 4, an embodiment of a connector circuit 18 is shown in a plane formed by the X- and Z-axis. The connector circuit 18 comprises connector electrodes 20. The electrodes 20 may extend along a line P approximately parallel to the Z-axis, perpendicular to the straight line Y. When the cartridge 3 is inserted or ejected along the straight line Y, the cartridge electrical circuit 19 moves along the electrodes 20 until they are connected. The connector circuit 18 is arranged to connect sideways to the cartridge electrical circuit 19, in a direction B transverse with respect to the straight line Y. In the drawings, the transverse direction B is parallel to the X-axis. In an installed condition of the cartridge 3, the connector circuit 18 and the cartridge electrical circuit 19 extend next to each other as seen from the direction of movement along the straight line Y. In the shown embodiment, the electrodes 20 comprise pins. The connector electrodes 20 are arranged to be moved in the transverse direction B. The electrodes 20 may comprise resilient members that are biased towards the cartridge electrical circuit 19, for electrical connection. The electrodes 20 are pushed backwards by the cartridge electrical circuit 19 during insertion of the cartridge 3. During insertion, the connector electrodes 20 may slide on the cartridge electrical circuit 19 until the cartridge 3 is locked in the receiving structure 4 and the electrodes 20 establish proper contact with the corresponding cartridge electrical circuit 19. At the same time, the resilient members push the electrodes 20 against the electrical circuit 19 for better electrical connection. When the cartridge 3 is again ejected out, the electrodes 20 again move outwards due to the resilient force.

The fluid ejection device 2 may comprise at least two different receiving keying interfaces 22. In an embodiment, each receiving structure 4 is provided with one specific receiving keying interface 22 that is different from the other receiving keying interfaces 22 of the other receiving structures 4. The receiving keying interface 22 corresponds to a particular ink color, for example cyan, magenta, yellow or black. In an embodiment, the fluid ejection device 2 comprises a specific receiving keying interface 22 for each particular fluid cartridge 3. In an embodiment, the fluid ejection device 2 comprises four receiving structure 2 with four respective receiving keying interfaces 22, each corresponding to a fluid cartridge 3 of a specific color having a corresponding cartridge keying interface 24.

The fluid ejection device 2 comprises receiving structures 4 having receiving keying interfaces 22 arranged to allow connection to a cartridge 3 with matching keying interfaces 24, and preventing connection with fluid cartridges 3 that are arranged with non-matching cartridge keying interfaces 24. For example, a first receiving keying interface 22 comprises a first notch 23 or cut out. A matching first cartridge keying interface 24 of a corresponding cartridge 3 comprises a corresponding inverse notch or cut out 25 that during insertion is not blocked by the first receiving keying interface 22, but is blocked when inserted in other receiving structures with other receiving keying interfaces 22. Likewise, the other cartridges 3 have a second, third, fourth, and/or further cartridge keying interface 24 that does not match the first receiving keying interface 22. The other second, third, fourth and/or further receiving keying interfaces do not match the first cartridge keying interface 24. The keying interfaces 22, 24 prevent that ink colors of the respective cartridge 3 and receiving structures 4 do not match.

The keying interface 22 of the receiving structure 4 may be arranged next to the connector circuit 18. The corresponding keying interface 24 of the cartridge 3 may be arranged next to the cartridge electrical circuit 19. If keying interfaces 22, 24 match, they may engage sideways so that the circuits 18, 19 may be pressed into contact. If the keying interfaces 22, 24 do not match, no electrical contact can be established. On the one hand, no electrical contact is made between the connector circuit 18 and the cartridge electrical circuit 19 if the keying interfaces do not match. On the other hand, a proper contact between the interconnecting circuits 18, 19 is aided by the respective keying interfaces 22, 24 of the receiving structure 4 and the cartridge 3, respectively.

The guide 17 is arranged to guide the corresponding fluid cartridge 3 along the straight line Y. The guide 17 is arranged to engage a corresponding guide interface of the cartridge 3, for example a guide track 21. The guide 17 comprises a rail that extends parallel to the Y-axis. The guide 17 is longer than each of the pens 13, to ensure proper alignment of the pens 12, 13 with the respective sockets 14, 15. This may provide for a good interconnection without leakage and may prevent deformation of the pens 12, 13. The guide 17 may comprise a T-rail for engaging the corresponding guide track 21 of the cartridge 3. A T-rail prevents rotation of the cartridge 3 around the straight line of movement Y, as well as around the other axes X, Z.

The receiving structure 4 comprises a latch arrangement 26 for locking the cartridge 3. In the shown embodiment, the latch arrangement 26 comprises a latch 27, arranged to be guided by a corresponding latch track 28 of the cartridge 3, between a locked and an unlocked position. The latch 27 may be arranged in the bottom of the receiving structure 4 for engaging the bottom 35 of the cartridge 3. The latch arrangement 26 may comprise a latch pivot 29 and a pivot arm 29B, to allow moving of the latch 27 between a locked and unlocked position, by pivoting around a pivot axis L. In the drawing, the pivot axis L is perpendicular to the straight line Y, parallel to the Z-axis. In an embodiment, the latch 27 is biased around the pivot axis L, so as to return to a starting position after ejection of the cartridge 3, and so as to engage respective latch track walls.

In an embodiment, the latch 27 comprises a pin. In a locked position, the latch 27 engages a corresponding latch stop 30 of the cartridge 3. In an unlocked position, the latch 27 is disengaged from the latch stop 30, so that the cartridge 3 can be released from the receiving structure 4. The latch 27 may extend on top of the pivot arm 29B. In an installed condition of the cartridge 3, the latch 27 extends in the latch track 28 while the pivot 29 and pivot arm 29B extend below the bottom 34 of the cartridge 3. In the shown embodiment, the latch arrangement 26 comprises latch boundaries 29C for limiting the movement of the latch 27. In an embodiment, the latch boundaries 29C are arranged to engage and limit the movement of the latch pivot arm 29B. In an inserted condition of the cartridge 3 the latch boundaries 29C extend under the cartridge 3.

The cartridge receiving structure 4 comprises an ejector 31. FIG. 3 shows the ejector 31 in a decompressed state, after ejection or before insertion of the cartridge 3. Each receiving structure 4 comprises an ejector 31. The ejector 31 is biased in a direction parallel to the straight line Y. The ejector 31 may comprise a spring, or another resilient element, for example an elastomeric element. The spring may comprise a helical spring. When the fluid cartridge 3 is inserted and latched, the leading end 44 of the ejector 31 engages the front face 33 of the cartridge 3. In the shown embodiment, the central axis C2 of the spring is equal to the central axis C2 of the second fluid pen 13. The second fluid pen 13 extends within the spring. The helical spring is attached to a base 32 of the second fluid pen 13. The size of the ejector spring is such that in a decompressed condition of the helical spring (FIG. 3), the cartridge 3 can be taken out by hand.

The ejector 31 is arranged to push the cartridge 3 out of the receiving structure 4. In an installed and locked condition, the cartridge 3 is retained in the receiving structure 4 by the latch 27, while compressing the ejector 31. The latch 27 may be directed from a locked to an unlocked position by further pushing the cartridge 3 against the force of the compressed ejector 31 along the straight line Y, as will be explained further below. In an unlocked position, the latch 27 releases the cartridge 3, and the ejector 31 decompresses so as to eject the cartridge 3 in a direction out of the receiving structure 4 along the straight line Y.

Figure 5:
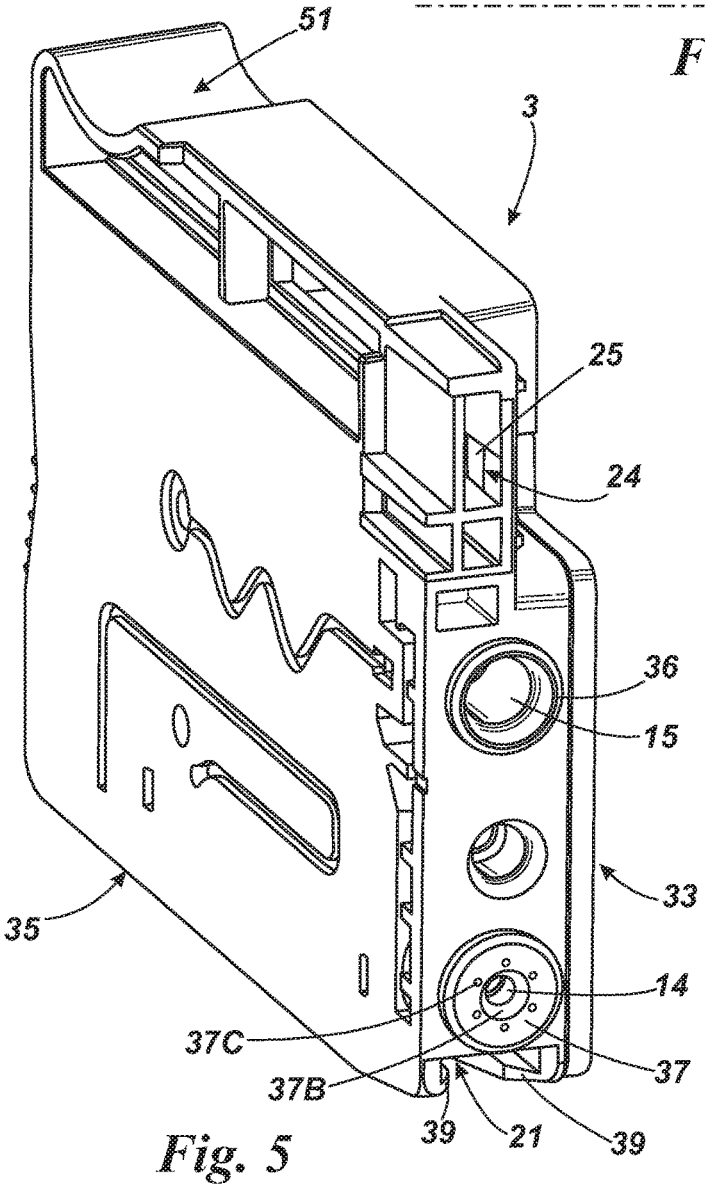
FIG. 5 illustrates a perspective view of an embodiment of a fluid cartridge.
Figure 6:
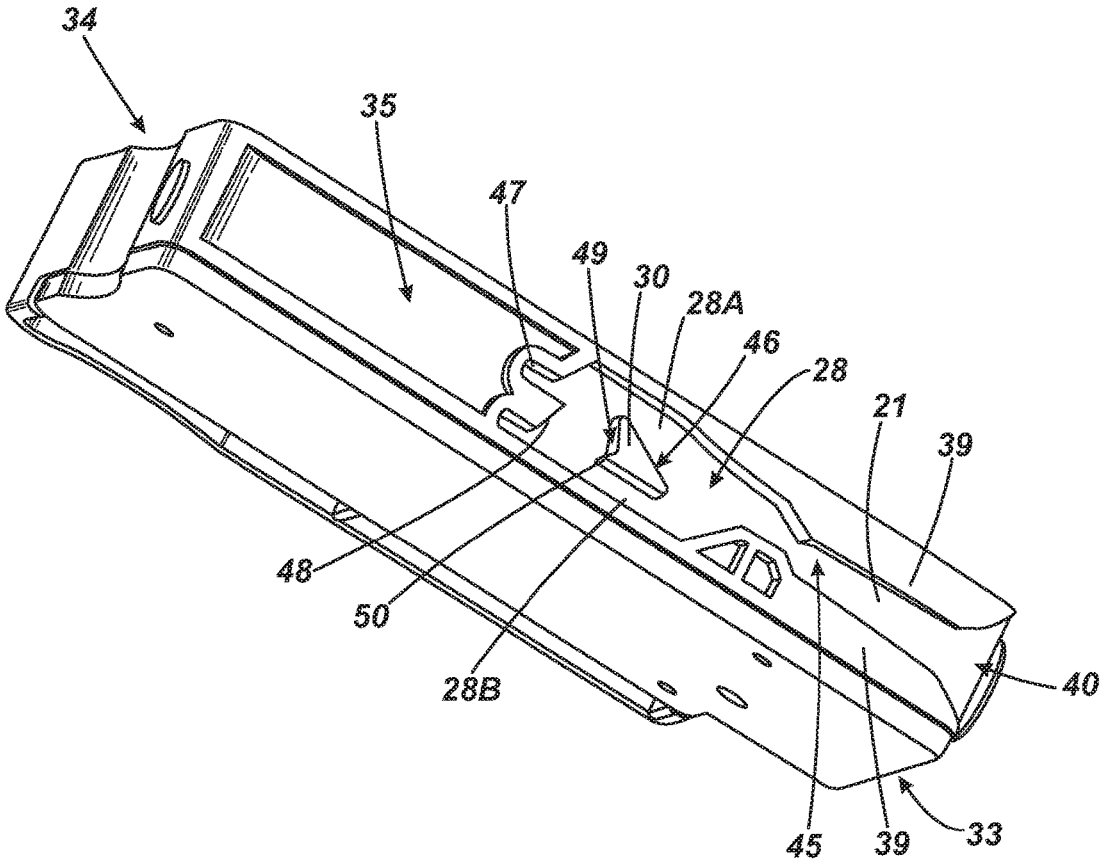
FIG. 6 illustrates another perspective view of the embodiment of the fluid cartridge of FIG. 5, clearly showing a guide track and a latch track.

FIGS. 5 and 6 illustrate an embodiment of a fluid cartridge 3 in perspective view. FIG. 5 clearly depicts the front face 33, while FIG. 6 more clearly depicts the bottom face 35. In the shown embodiments, the fluidic, electric and keying interfaces are arranged on the front face 33. The guide interface, latch track 28 and latch stop 30 are arranged on the bottom face 35.

The fluidic interfaces of the cartridge 3 comprise a first cartridge fluidic interface for a first fluid and a second cartridge fluidic interface for a second fluid. In an embodiment, the first fluid comprises a print fluid or liquid such as ink, and the second fluid comprises a gas such as air. In the shown embodiment, the first and second cartridge fluidic interfaces comprise a first and a second socket 14, 15, respectively, arranged to receive and transport fluid from and/or to respective pens 12, 13, respectively. The first socket 14 may be connected to an inner volume of the cartridge 3. The second socket 15 may be connected to a pressure bag in the inner volume of the cartridge 3.

The depth of the respective socket 14, 15 is approximately the same as or shorter than a length of the guide 17 or guide track 21, to receive the respective pen 12, 13 after engagement of the cartridge 3 with the guide 17, to ensure proper alignment with the respective pen 12, 13. The central axes C1, C2 of the sockets 14, 15 are parallel to the straight line Y. In an installed condition of the cartridge 3, the central axes C1, C2 of the sockets 14, 15 are approximately the same as the central axes C1, C2 of the respective receiving fluidic interfaces 12, 13.

The cartridge 3 may comprise an ejector alignment interface 36 on the front face 33. In an embodiment, the ejector alignment interface 36 is arranged near and/or around one of the cartridge fluidic interfaces, which in the shown embodiment are arranged as sockets 14, 15. In the shown embodiment, the ejector alignment interface 36 is arranged around the second socket 15, having the same central axis C2 with the second socket 15, and in an inserted condition of the cartridge 3, the same central axis C2 as the second pen 13. In the shown example, the ejector alignment interface 36 comprises a ring, for example in the shape of a ridge or flange around the second socket 15, for engaging the inner circumference of the leading end 44 of the spring shaped ejector 31, for aligning and maintaining the ejector 31 in position when engaging the cartridge 3.

The first socket 14 comprises seal ring 37 for receiving the first pen 12. The seal ring 37 comprises resilient material, for example elastomeric material, to at least substantially fluid tightly enclose the first fluidic pen 12, in a connected condition of the first pen 12. As will be explained further below, at an insertion and ejection stage, the pen 12 is inserted further inwards into the first socket 14, as compared to a position wherein the pen 12 is connected for printing. Therefore the seal ring 37 is arranged to allow further deformation, to allow such further insertion of the first pen 12. The inner diameter of the seal ring 37 is such that it fluid tightly encloses the first pen 12 from a narrow portion of the conical shape of the pen 12 up to a wider portion. For example, the pen 12 may have a smallest diameter of approximately 2.0 and a largest diameter of approximately 2.3 millimeter along the coned shape. In other embodiments the pen 12 may have a smallest diameter of at least approximately 1.5 and/or a largest diameter of approximately 3.5 millimeter or less along the coned shape of the pen 12. Again further embodiments may have smaller and/or larger diameters, respectively.

The seal ring 37 is arranged to fluid tightly enclose the first pen 12 along a substantial part of the length of the first pen 12. In an embodiment, the inner diameter of the seal ring 37 is approximately 1.2 millimeters. Depending on the diameter of the pen 12, in other embodiments the inner diameter of the seal ring 37 may be between approximately 0.6 and approximately 3.0 millimeters. The inner diameter of the seal ring 37 may stretch while maintaining its fluid tight pen enclosing characteristics when the pen 12 slides through the seal ring 37, for example at least approximately 0.3 millimeters, or in another embodiment at least approximately 0.6 millimeters, or in another embodiment at least approximately 1.6 millimeters. In the shown embodiment, the seal ring 37 comprises a tapering receiving mouth 37B for aligning the first pen 12 at insertion. In the shown embodiment, the seal ring 37 comprises bumps 37C, arranged to prevent that the seal ring 37 sticks against an opposite engaging surface, for example at insertion in the receiving structure and/or at manufacture.

The cartridge 3 comprises an electrical circuit 19 (FIG. 3). In the shown embodiment, the electrical circuit 19 is sunken with respect to the front face 33, so that electrical contact with the connector circuit 18 is made only after the other interfaces are connected. In an embodiment, this may prevent that a printer receives electrical signals before the fluidic interfaces 12, 14, 13, 15 are connected. Such electrical signals sometimes trigger a printer to actuate a printhead 5 and/or cartridge 3, which may be prevented by certain embodiments of this disclosure.

The cartridge electrical circuit 19 is arranged to connect sideways, when inserted in the receiving structure 4. In connected condition, the connector circuit 18 extends at least partly within the cartridge 3. For example, the cartridge electrical circuit 19 comprises electrodes 38 extending in one plane, approximately perpendicular to the front face 33 of the cartridge 3, and parallel to the insertion direction, and/or a plane formed by the Z-axis and Y-axis. In an embodiment, the electrodes 38 of the cartridge electrical circuit 18 extend along a line PP that is approximately parallel to the Z-axis and/or the front face 33, in an installation position of the cartridge 3. The line PP extends behind the front face 33. The electrodes 38 of the cartridge electrical circuit 19 are arranged to connect to the corresponding electrodes 20 of the connector circuit 18. The line PP that extends through the electrodes 38 of the cartridge 3 is parallel to the line P (FIG. 4) that extends through the electrodes 20 of the connector circuit 18, in an installed condition of the cartridge 3. In an installed condition, the connector circuit 38 extends at least partly through or behind the front face 33 of the cartridge 3, for connection with the cartridge electrical circuit 18.

In an embodiment, the cartridge 3 comprises a cartridge keying interface 24 for preventing connection to a receiving structure 4 that is arranged with a non-matching keying interface 22. In the shown embodiment, the cartridge keying interface 24 comprises a cut out 25. In other embodiments, the cartridge keying interface 24 may comprise a protrusion, and in again other embodiments it may comprise both. The cartridge keying interface 24 is arranged to block further insertion of the cartridge 3 if the receiving keying interface 22 does not match. The cartridge keying interface 24 is arranged to block insertion of the connector circuit 18 into the cartridge 3 if the receiving keying interface 22 does not match, so that electrical connection with the cartridge electrical circuit 19 will fail.

The keying interfaces 22, 24 may be arranged to provide additional alignment of the cartridge 3 with respect to the receiving structure 4, in addition to the guide 17, for example preventing rotation around the straight line of movement Y. Furthermore, if the keying interfaces 22, 24 of the receiving structure 4 and the cartridge 3 match, the keying interfaces 22, 23 may engage due to their corresponding shape, so that the circuits 18, 19 are interconnected properly.

In some embodiments, the cartridges 3 are not provided with a keying interface 24 so that the cartridges 3 may match any of the receiving structures 4 of the fluid injection device 1, and the circuits 18, 19 interconnect, regardless of the receiving keying interface 24.

The cartridge 3 comprises a guide interface for cooperation with the guide 17 of the receiving structure 4. In the shown embodiment, the guide interface comprises a guide track 21. The guide interface is arranged for guiding the cartridge 3 along a straight line Y for connecting the interfaces. The guide interface may have a guide engaging surface that extends parallel to said straight line Y.

The guide track 21 is arranged for engaging the guide 17. The guide track 21 may be arranged to guide a corresponding T-rail guide 17. In the shown embodiment, the guide track 21 comprises a T-shaped cut out. The guide track 21 comprises flanges 39 for engaging under the wings 17B (FIG. 3) of the Trail guide 17. The guide track 21 may comprise a tapered opening 40 for facilitating easy reception of the T-rail guide 17. The flanges 39 may be tapered near the opening 40. The guide track 21 may further comprise a guide stop 45.

The bottom 35 of the cartridge 3 further comprises a latch track 28. The guide track 21 and the latch track 28 may comprise one integral cut out in the bottom 35 of the cartridge 3. The bottom 35 may comprise an integrally molded plastic shape.

The cartridge 3 comprises a latch track 28 and a latch stop 30. The latch track 28 is arranged to move the latch 27 with respect to the latch stop 30. Once the latch 27 engages the latch stop 30, the cartridge 3 is retained. The position of the latch stop 30 may determine the location of the cartridge interfaces with respect to the receiving structure interfaces, along the straight line Y.

Figure 13:
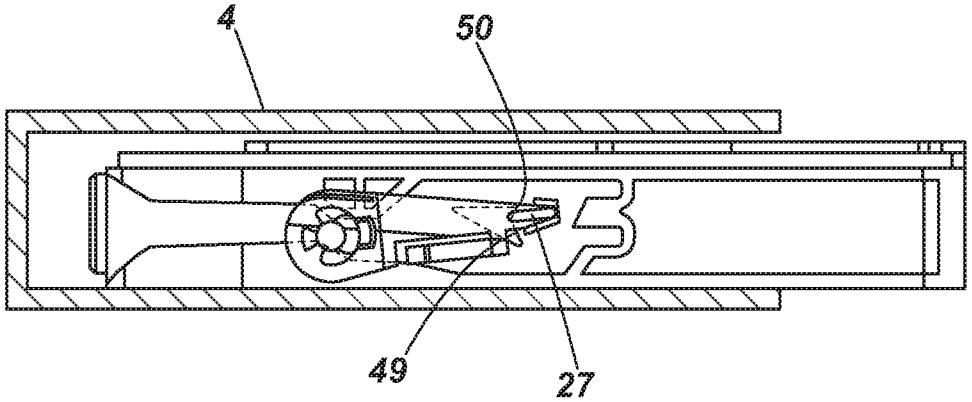
FIG. 13 illustrates a diagrammatic cross sectional bottom view of the embodiment of the fluid cartridge and the cartridge receiving structure of FIGS. 10-12, in a final stage of connecting the fluid cartridge, wherein the latch arrangement is made semi-transparent for reasons of illustration.

The latch track 21 comprises a locking track 28A and an unlocking track 28B. The locking track 28A may be fully or partially different from the unlocking track 28B. The latch stop 30 is arranged between the locking track 28A and the unlocking track 28B, so that the latch 27 is guided on one side 28A of the latch stop 30 during insertion, and on an opposite side 28B at ejection. At insertion, the latch 27 is guided by the locking track 28A. The locking track 28A may comprise a latch guiding surface 46 of the latch stop 30, for guiding the latch 27 on the correct side of the latch stop 30. The locking track 28A may further comprise a latch guide wall 47, at the end of the locking track 28A. The latch guide wall 47 is arranged to receive the latch 27 at the end of the locking track 28A, and direct the latch 27 to the latch stop 30. The latch stop 30 comprises a latch stop wall 49 and a latch abutment 50. The latch guide wall 47 is arranged to guide the latch 27 into an engaging locked position with the latch stop wall 49 (FIG. 13). The abutment 50 comprises a protrusion in the stop wall 49 for keeping the latch 27 from sliding off the latch stop wall 49. In the locked position, the latch 27 engages the abutment 50. In the locked position, the ejector 31 is compressed and pushes the cartridge 3 so that the latch stop 30 is pushed against the latch 27.

Furthermore, the unlocking track 28B comprises a latch re-direct wall 48. The latch re-direct wall 48 is arranged to receive the latch 27 when the latch stop 30 and latch track 28A are pushed inwards, and to guide the latch 27 into the unlocking track 28B for ejection, out of the latch stop engagement position. At ejection, the latch 27 passes the opposite side of the latch stop 30, with respect to insertion. The latch re-direct wall 48 may be arranged at the end of the latch track 28. Once the latch 27 is in an unlocked position, the ejector 31 ejects the cartridge 3 so that it can be taken out manually.

In an embodiment, the latch track 28 comprises audible and/or tactile feedback members. The latch 27 may be biased around it pivot axis L. The latch 27 may slide against latch track walls while the latch 27 travels through the latch track 28. For example, one or more latch track walls may comprise one or more feedback members such as ledges to provide for audible and/or tactile feedback while the latch 27 travels in the latch track 28. The feedback members may be provided near the latch guide wall 47, from where latch 27 will move into a locked position if the cartridge 3 is released. When receiving audible and/or tactile feedback, a user may know that the cartridge 3 may be released and that it is locked to the receiving structure 4. Another feedback member may be provided near the latch re-direct wall 48 for indicating an unlocking of the cartridge 3.

Figure 7:
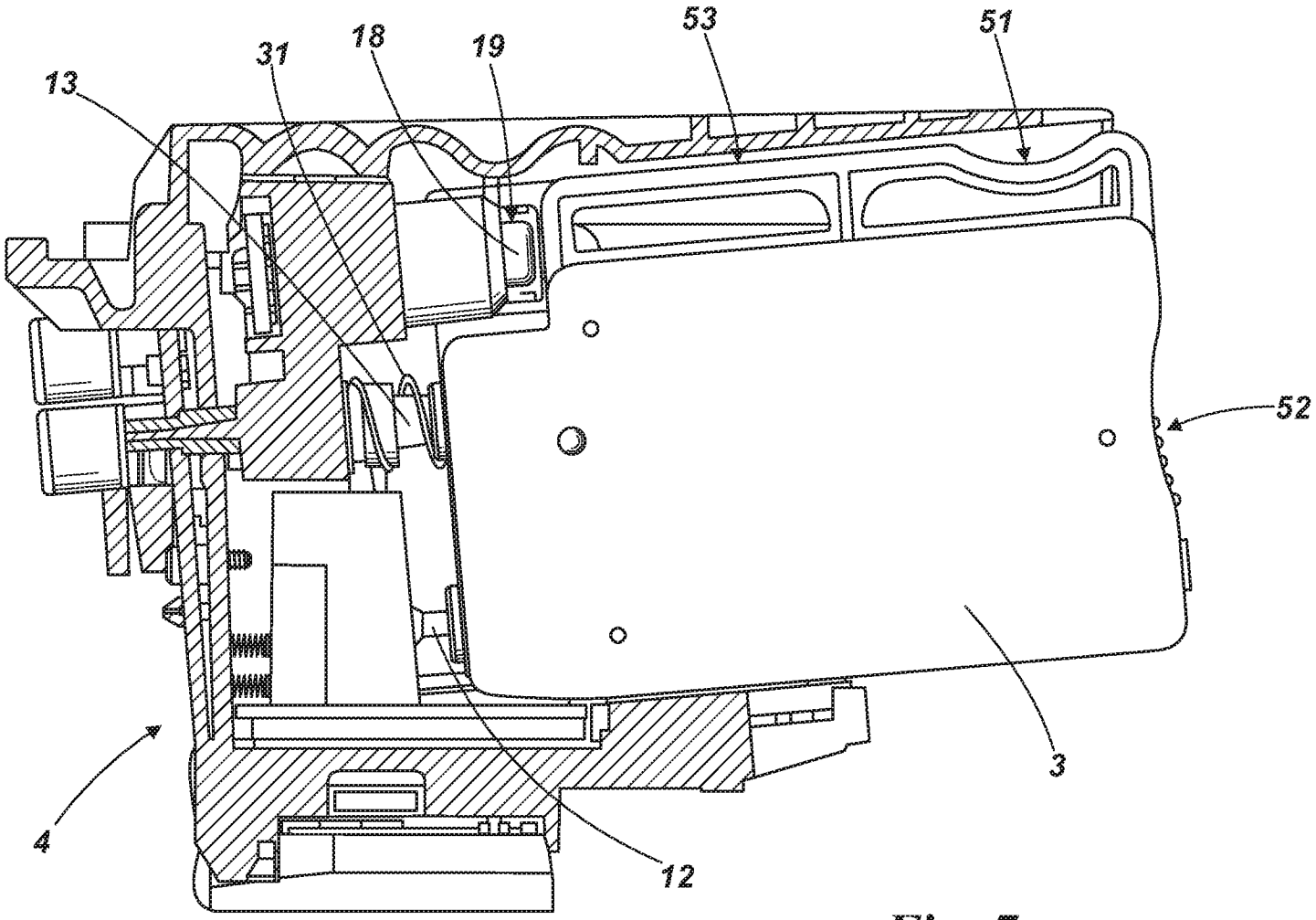
FIG. 7 illustrates a cross sectional side view of the embodiment of the part of the fluid ejection system of FIG. 3 wherein the fluid cartridge is connected to the cartridge receiving structure.

FIG. 7 shows a cross section of a part of the fluid ejection system 1, wherein the fluid cartridge 3 and the receiving structure 4 are connected. The ejector 31 is compressed and pushes the cartridge latch stop 30 against the latch 27. The cartridge 3 is further held in place by the guide 17. The pens 12, 13 extend largely within the respective sockets 14, 15 for transporting the respective fluids between the cartridge 3 and the fluid ejection device 2.

The electrodes 20, 38 of the connector circuit 18 and the cartridge electrical circuit 19, respectively, interconnect sideways. For example, the electrodes 20, 38 interconnect along a line P or PP that is parallel to the Z-axis, and/or in a plane that is parallel to the plane formed by the Y-axis and the Z-axis. Since the cartridge electrical circuit 19 is sunken with respect to the front face 33 of the cartridge 3, the connector circuit 18 and the cartridge electrical circuit 19 interconnect within the outer circumference of the cartridge 3, behind the front face 33. In an installed condition, the connector circuit 18 extends at least partly within the cartridge 3. In an embodiment, the connection between the connector circuit 18 and the cartridge electrical circuit 19 is established behind and/or next to a cartridge keying interface 24, within the cartridge 3.

In an embodiment, the cartridge 3 comprises at least one finger engagement surface 51 to facilitate and indicate manual handling of the cartridge 3, for example when inserting or taking out the cartridge 3. The finger engagement surface 51 may comprise one or a combination of an inwards curve, one or more ribs, a cut out, etc. The finger engagement surface 51 may be arranged on the top face 53 of the cartridge 3, and close to the back face 34. As illustrated in the shown embodiment, in an installed condition of the cartridge 3, the receiving structure 4 largely covers the finger engagement surface 51. After ejection, the finger engagement surface 51 is visible and free to be engaged for taking out the cartridge 3.

In an embodiment, the cartridge 3 comprises a finger push surface 52 to indicate that the cartridge 3 needs to be pushed into the receiving structure 4, for both locking and unlocking of the cartridge 3. The finger push surface 52 may comprise one or a combination of an inwards curve, one or more ribs, a cut out, etc. The finger push surface 52 is arranged in the back face 34. In an installed condition of the cartridge 3, the back face 34 and the finger push surface 52 are visible outside of the receiving structure 4. Although the finger push surface 52 may have a predetermined location on the back face 34, an aspect of certain embodiments of this disclosure is that the cartridge 3 may be pushed on any location of the back face 33 for proper connection of the interfaces, because guide 17 may guide the cartridge 3 along the straight line Y, irrespective of a specific pushing location or inclination.

Figure 8:
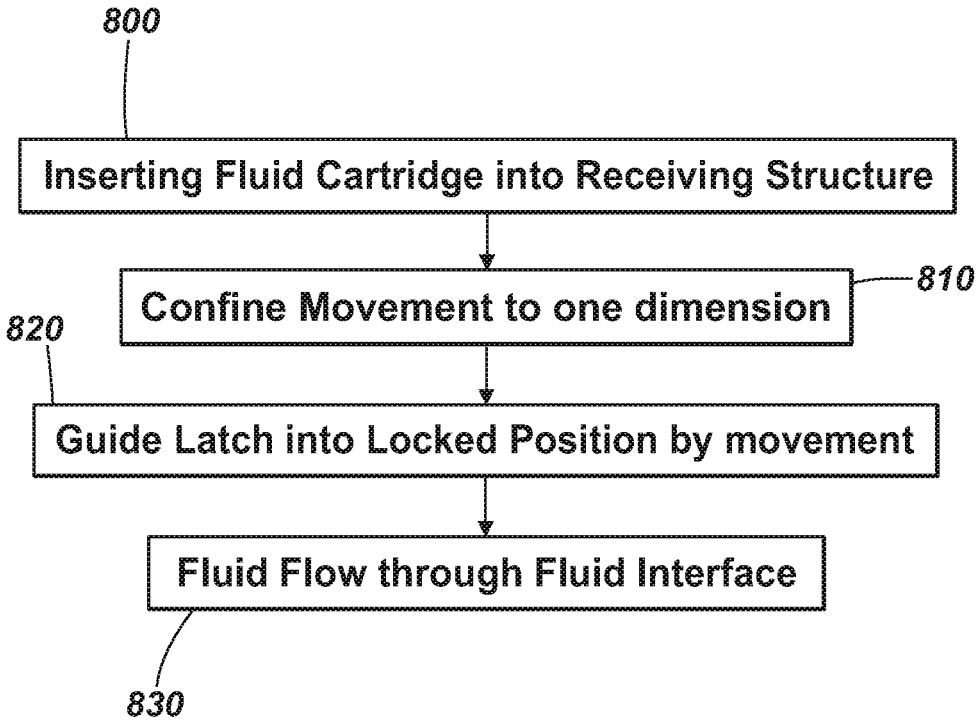
FIG. 8 illustrates a flow chart of an embodiment of a method of connecting a fluid cartridge to a receiving structure.

FIG. 8 shows an embodiment of a method of connecting a fluid cartridge 3 to a receiving structure 4 in a flow chart. In a first stage 800 of such method, a fluid cartridge 3 is inserted in a receiving structure 4. The movement is confined to one dimension, that is, the cartridge 3 is moved along the straight line Y, as indicated by stage 810. At the end of the one dimensional movement, a fluidic connection is established between the cartridge 3 and the fluid ejection device 2. In a stage 820, the latch 27 is guided into the locked position by the movement along the straight line Y. The latch 27 maintains the fluidic connection. Stage 810 and 820 may occur simultaneously. In a stage 830, fluid may flow through the connected fluidic interfaces, for example for fluid ejection.

Figure 9:
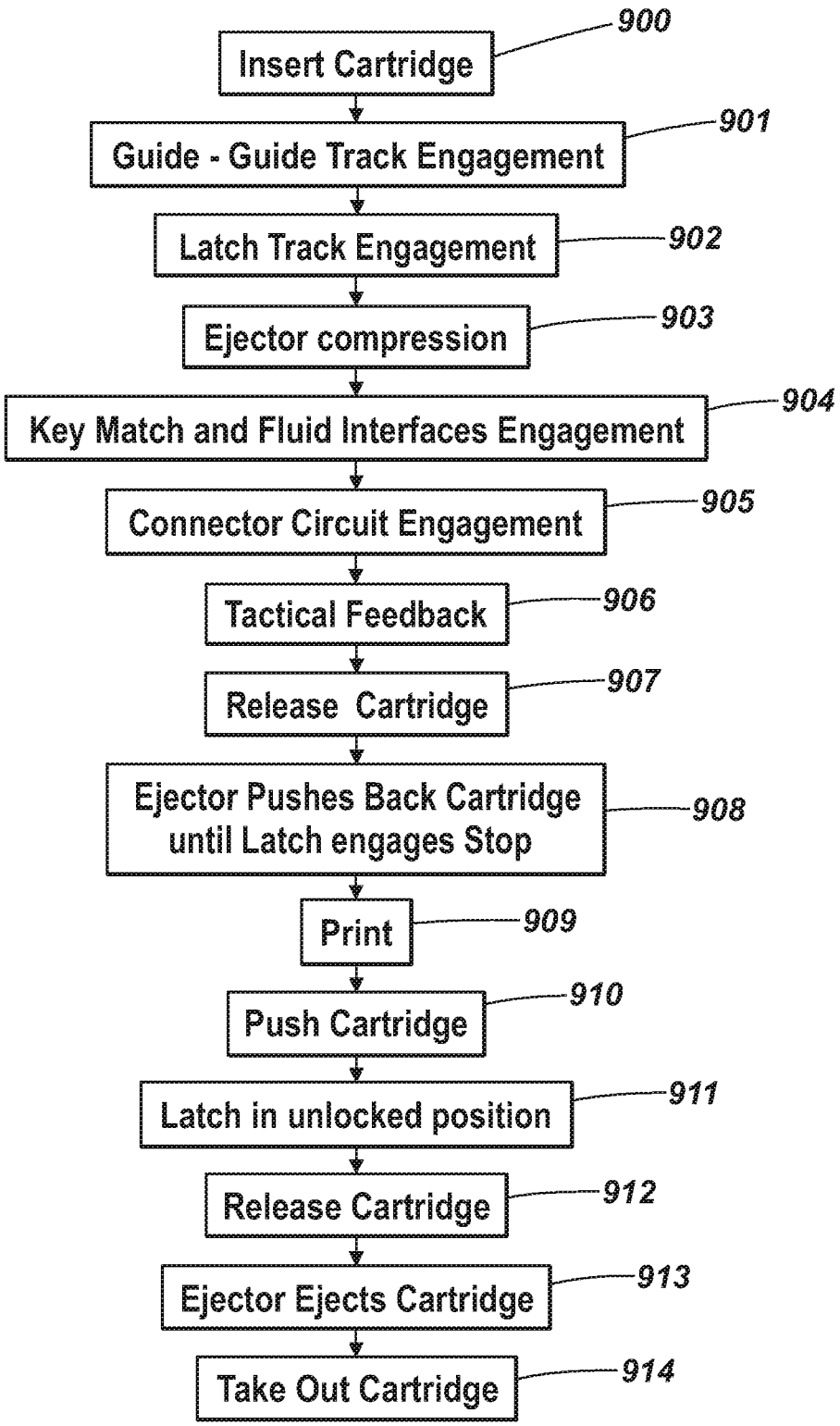
FIG. 9 illustrates a flow chart a further embodiment of a method of connecting and disconnecting a fluid cartridge with respect to a receiving structure.

FIG. 9 shows a further embodiment of a method of connecting a fluid cartridge 3 to a receiving structure 4 in a flow chart. FIG. 10-15 illustrate sequential positions of the cartridge 3 with respect to the latch arrangement 26, corresponding to some of the stages 900-914 of FIG. 9.

Figure 10:
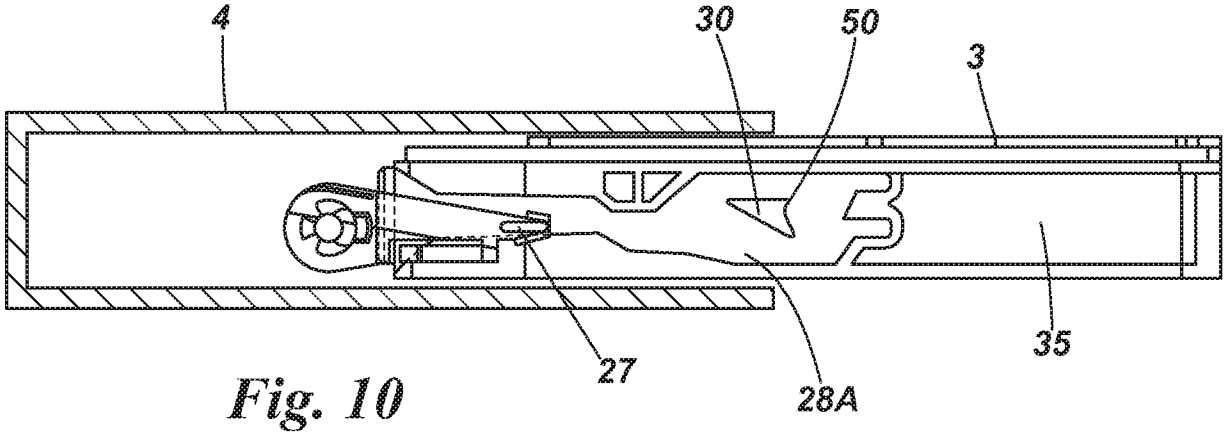
FIG. 10 illustrates a diagrammatic cross sectional bottom view of an embodiment of a fluid cartridge and a cartridge receiving structure, in a first stage of connecting the fluid cartridge, wherein the latch arrangement is made semi-transparent for reasons of illustration.
Figure 11:
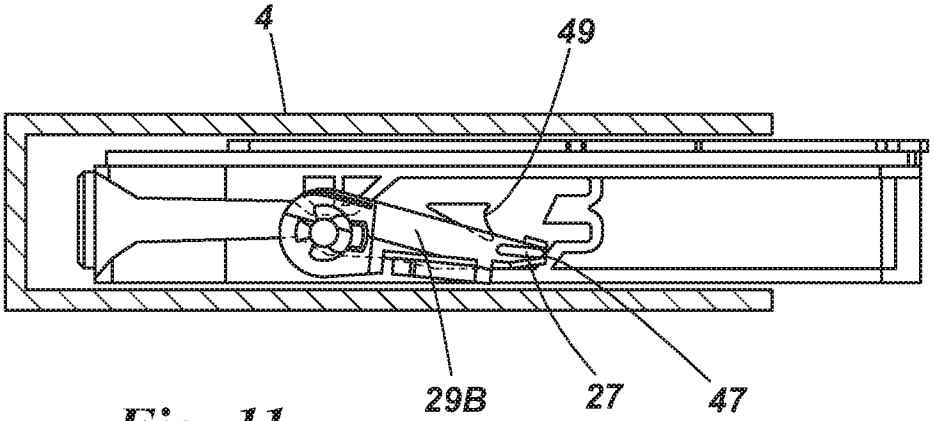
FIG. 11 illustrates a diagrammatic cross sectional bottom view of the embodiment of the fluid cartridge and the cartridge receiving structure of FIG. 10, in a second stage of connecting the fluid cartridge, wherein the latch arrangement is made semi-transparent for reasons of illustration.
Figure 12:
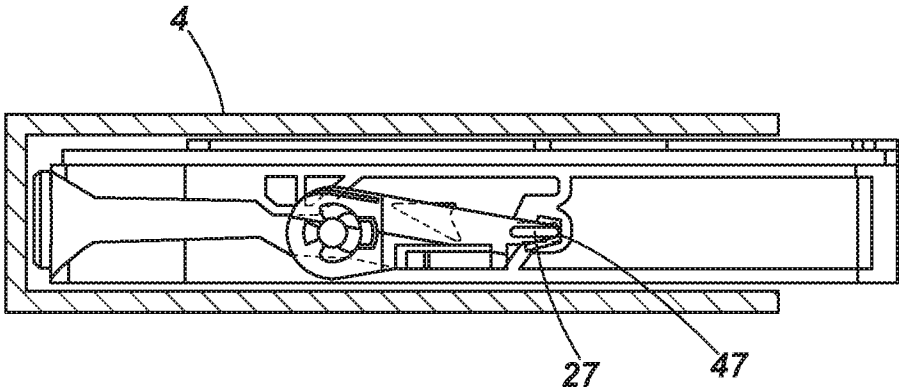
FIG. 12 illustrates a diagrammatic cross sectional bottom view of the embodiment of the fluid cartridge and the cartridge receiving structure of FIGS. 10 and 11, in a third stage of connecting the fluid cartridge, wherein the latch arrangement is made semi-transparent for reasons of illustration.

In a stage 900, the cartridge 3 is manually inserted into the receiving structure 4. FIG. 10 corresponds to stage 900, wherein the position of the cartridge 3 with respect to the receiving structure 4 and the latch arrangement 26 are illustrated. In a next stage 901, the guide track 21 engages the guide 17. By further pushing the cartridge 3 into the receiving structure 4, the guide 17 guides the cartridge 3 along the straight line Y, in the direction of the ejector 31. In a further stage 902, the latch 27 engages the latch track 28. The latch 27 is guided along the locking track 28A, as illustrated by FIG. 11. The pivot arm 29B pivots around pivot axis L (FIG. 3), to allow the latch 27 to be guided by the walls of the locking track 28A. In stage 903, the ejector 31 engages the front face 33 of the cartridge and is compressed. The ejector 31 may engage the ring 36 that is provided around a second pen receiving socket 15. Said stages 901-903 may take place simultaneously.

In the embodiment shown in FIGS. 9-15, the cartridge 3 and the receiving structure 4 have matching keying interfaces 22, 24. In a stage 904, the fluidic interfaces 12, 13, 14, 15 are interconnected and the keying interfaces 22, 24 of the receiving structure 4 and the cartridge 3 match. The matching keying interfaces 22, 24 allow the cartridge electrical circuit 19 and the connector circuit 18 to interconnect. After the key match, in stage 905, the electrical connection between the circuits 18, 19 is established. The control circuit 8 receives a corresponding signal that the electrical connection is established. The established electrical connection implies that the fluidic connections are also established.

In a stage 906, the user pushes the cartridge 3 in until receiving a tactical and/or audible feedback. For example, the latch 27 engages the end 47 of the latch track 28 and/or the guide stops 45 engage an end of the guide 17 and/or the ejector 33 cannot be compressed further. In the corresponding FIG. 12 it is shown that the latch 27 engages the end of the latch track 28, in this embodiment the latch 27 engages the latch guide wall 47 for directing the latch 27 in a locked position when released. In a stage 907, the user will manually release the cartridge 3. In a stage 908, the ejector 31 decompresses, pushing the cartridge 33 backwards until the latch 27 engages the latch stop 30. As can be seen from corresponding FIG. 13, the latch 27 retains the cartridge 3 by engaging the latch stop wall 49. The latch 27 is held in position by the abutment 50. The stages 904 and 905 of the key match and electrical connection, and the stages 906-908 of the latch lock may take place approximately simultaneously.

If the cartridge 3 is not pushed in correctly, the fluidic and/or other interfaces may not have been properly connected. In such case, the latch 27 may not reach the latch guide wall 47 and does not reach the locked position. Then, the cartridge 3 will automatically be pushed out by the ejector 31, before any electrical and/or fluidic connection is made.

Figure 14:
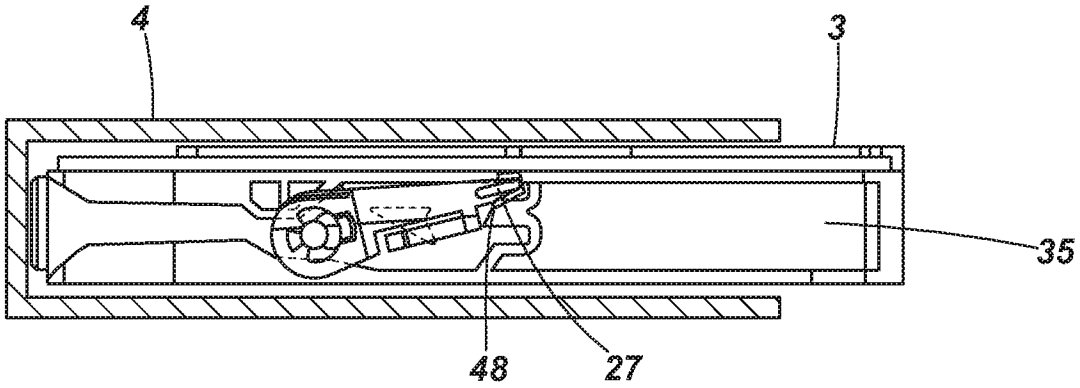
FIG. 14 illustrates a diagrammatic cross sectional bottom view of the embodiment of the fluid cartridge and the cartridge receiving structure of FIGS. 10-13, in a first stage of disconnecting the fluid cartridge, wherein the latch arrangement is made semi-transparent for reasons of illustration.
Figure 15:
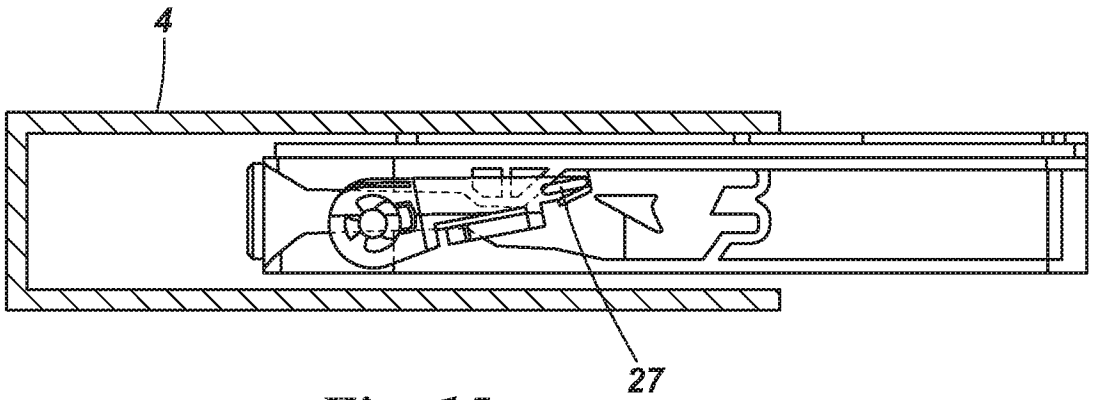
FIG. 15 illustrates a diagrammatic cross sectional bottom view of the embodiment of the fluid cartridge and the cartridge receiving structure of FIGS. 10-14, in a second stage of disconnecting the fluid cartridge, wherein the latch arrangement is made semi-transparent for reasons of illustration.

In a stage 909, the fluid ejection system 1 prints by retrieving the first fluid from the cartridge 3, through the first fluidic interfaces 12, 14. After printing, for example when the cartridge 3 is substantially empty, the cartridge 3 may be ejected for replacement. In a stage 910, a user pushes the cartridges 3 in the direction of the ejector 31. By pushing the cartridge 3, the latch 27 may engage the latch re-direct wall 48. In a next stage 911, the latch 27 is guided into an unlocked position, for example by the latch re-direct wall 48 (FIG. 14). In the unlocked position, the cartridge 3 is no longer retained by the latch 27. In a stage 912, a user may manually release the cartridge 3. In a stage 913, the ejector 31 decompresses, ejecting the cartridge 3 (FIG. 15). Ejection is made possible since the cartridge 3 is no longer retained (FIG. 15). In stage 914, the user takes the cartridge 3 out of the receiving structure 4.

As described, the cartridge 3 may comprise a first fluidic interface 12, a second fluidic interface 13, an electrical interface 19, an ejector alignment interface 36, and/or a keying interface 24, which are arranged in the front face 33. The guide interface is arranged in the bottom face 35, having a receiving opening 40 near the front face 33. Hence, the interfaces are arranged to engage near the front surface 33 of the cartridge 3. In the shown embodiment, the keying interface 24 and the electrical interface 19 are arranged near the top surface 53, the second fluidic interface 15 and the ejector alignment interface 36 are arranged near the middle of the front surface 33, and the first fluidic interface 14 and the guide receiving opening 40 are arranged near the bottom face 35. The interfaces are relatively evenly distributed over the front face 33, providing for a relatively even distribution of the connecting forces of the respective interfaces, and relatively low total connection force, for example around 14 Newton or less. In the latch and guide mechanisms of the fluid ejection system 1, no deformation of latch or guide parts is necessary. A relatively light and simple push is sufficient for establishing a secure lock. Furthermore, the guide 17 allows for a user to push on any location of the back face 34 of the cartridge 3 for establishing all connections in one direction Y.

The cartridge 3 and receiving structure 4 may be relatively thin, consuming just a small volume of the printer. The cartridge motion track also consumes relatively little space because it comprises a straight line Y. Moreover, the cartridge 3 may be released using the same push motion in the same direction Y. If the cartridge 3 is not properly connected, for example fluidically and/or electrically, the cartridge 3 is automatically pushed out by the ejector 31.

The above description is not intended to be exhaustive or to limit the invention to the embodiments disclosed. Other variations to the disclosed embodiments can be understood and effected by those skilled in the art in practicing the claimed invention, from a study of the drawings, the disclosure, and the appended claims. In some embodiments, mechanical inversions may be applied with respect to the shown embodiments. For example, the latch track 28 may be provided on the receiving structure 4, while the latch arrangement 26 may be provided in the cartridge 3. The first and second fluidic interfaces of the cartridge 3 may comprise pens, while the corresponding first and second fluidic interfaces of the receiving structure 4 may comprise sockets.

The indefinite article "a" or "an" does not exclude a plurality, while a reference to a certain number of elements does not exclude the possibility of having more elements. A single unit may fulfil the functions of several items recited in the disclosure, and vice versa several items may fulfil the function of one unit.

In the following claims, the mere fact that certain measures are recited in mutually different dependent claims does not indicate that a combination of these measures cannot be used to advantage. Multiple alternatives, equivalents, variations and combinations may be made without departing from the scope of the invention.

What is claimed is:

1. An ink cartridge comprising:

interfaces, in a front face of the cartridge, for connection to a cartridge receiving structure, the interfaces including an ink interface to provide ink and an air interface to pressurize an inner volume of the cartridge;

a guide interface to guide the cartridge along a straight line for connecting the interfaces to the cartridge receiving structure, the guide interface comprising a guide track that extends parallel to said straight line; and a latch track and a latch stop, in a bottom face of the cartridge, to guide and retain a latch of the cartridge receiving structure;

wherein the latch track comprises a locking track and an unlocking track, and is arranged to guide the latch, with respect to the latch stop, along the locking track into a locked engagement position at insertion of the cartridge, and along an unlocking track, different from the locking track, into an unlocked position at ejection of the cartridge;

wherein the latch track comprises a latch guide wall at an end of the locking track to receive a latch at the end of the locking track and to direct the latch to the latch stop;

wherein the unlocking track comprises a latch re-direct wall to receive the latch when the latch stop and the latch track are pushed inwards for ejection of the cartridge and to guide the latch out of a latch stop engagement position and into the unlocking track for ejection of the cartridge; and the cartridge further comprising a latch guide that comprises a ramp, at a beginning of the latch track and at spaced apart from the front face, that protrudes into the latch track, such that engagement with the ramp repositions the latch to a start position during ejection of the ink cartridge from the cartridge receiving structure such that, in the start position, the latch is positioned for engaging the locking track, rather than the unlocking track, upon a subsequent insertion of a subsequent cartridge in the cartridge receiving structure;

the cartridge further comprising an electrical circuit comprising a cartridge memory to provide cartridge characteristic data, wherein the electrical circuit extends in a plane perpendicular to the front face of the cartridge and electrodes of the memory extend along a line parallel to the front face and behind the front face;

wherein the electrical circuit is arranged behind the front face and at a top face of the cartridge, and the air interface is arranged in the front face between the electrical circuit and the ink interface; and wherein the ink and air interfaces are both located on a common vertical axis perpendicular to vertical side faces of the cartridge when oriented for connection to the cartridge receiving structure.

2. The cartridge of claim 1, wherein the guide track is in a bottom face of the cartridge, opposite the top face as the cartridge is oriented for insertion to the cartridge receiving structure.

3. The cartridge of claim 1, further comprising an ejector alignment interface on the front face of the cartridge.

4. The cartridge of claim 3, wherein the ejector alignment interface comprises a circular ridge for engaging an inner circumference of an end of a helical spring ejector.

5. The cartridge of claim 3, wherein the air interface comprises a socket, and wherein the ejector alignment interface is arranged around the socket of the air interface and has a common central axis with the socket of the air interface.

6. The cartridge of claim 5, wherein the air socket and ejector alignment interface are disposed on the front face, between the ink socket and electrical circuit.

7. The cartridge of claim 1, wherein the electrical circuit is disposed in a cut out that is open at both the front and top faces of the cartridge.

8. The cartridge of claim 7, wherein the electrical circuit is in the cut out to connect with a connector circuit of the cartridge receiving structure within an outer circumference of the ink cartridge and behind the front face.

9. The cartridge of claim 7, wherein electrodes of the electrical circuit are arranged vertically in the cut out to establish a sideways connections with electrodes of the cartridge receiving structure.

10. The cartridge of claim 9, the vertically arranged electrodes of the electrical circuit are aligned parallel to the common vertical axis.

11. The cartridge of claim 1, wherein the ink interface comprises a socket for receiving a conically shaped pen of the cartridge receiving structure, the ink interface comprising a resilient seal ring having an inner diameter arranged to stretch approximately 0.3 millimeters for forming a seal with the pen along its conical shape at insertion.

12. The cartridge of claim 11, wherein the seal ring comprises a tapering receiving mouth for aligning the pen at insertion.

13. The cartridge of claim 1, wherein the guide track comprises a tapered receiving opening.

14. The cartridge of claim 1, wherein the latch stop comprises a latch stop wall and a latch abutment, the abutment comprising a protrusion in the latch stop wall for keeping the latch from sliding off the latch stop wall.

15. The cartridge of claim 1, wherein the cartridge has a smaller width than height when oriented for connection to the cartridge receiving structure to facilitate accommodating multiple such cartridges in the cartridge receiving structure of a scanning printhead on a scanning axis.

16. The cartridge of claim 1, wherein the guide track and the latch track are comprised in one integral cut out in the bottom face of the cartridge.

17. An ink cartridge comprising:

interfaces for connection to a cartridge receiving structure, the interfaces being located in a front face of the cartridge and including an ink socket to provide ink to a printer, and an air socket to pressurize an inner volume of the cartridge;

a guide interface, in a bottom face of the cartridge to guide the cartridge along a straight line for connection to the cartridge receiving structure, the guide interface comprising a guide track that extends parallel to said straight line; and a latch stop and a latch track, in the bottom face of the cartridge, to guide and retain a latch of the cartridge receiving structure, wherein the latch stop comprises a latch stop wall and a latch abutment, the latch abutment comprising a protrusion in the latch stop wall for keeping the latch from sliding off the latch stop wall;

wherein the latch track comprises a locking track and a separate unlocking track, and is arranged to move the latch with respect to the latch stop along the locking track into a locked engagement position at cartridge insertion, and along the unlocking track into an unlocked position at cartridge ejection;

wherein the latch track further comprises a latch guide wall at an end of the locking track to receive the latch at the end of the locking track and to direct the latch to the latch stop;

wherein the unlocking track comprises a latch re-direct wall to receive the latch when the latch stop and the latch track are pushed inwards for ejection of the cartridge and to guide the latch out of a latch stop engagement position, past the latch abutment, and into the unlocking track for ejection of the cartridge; and the cartridge further comprising a latch guide that comprises a ramp, at a beginning of the latch track and spaced apart from the front face, that protrudes into the latch track, such that engagement with the ramp repositions the latch to a start position during ejection of the ink cartridge from the cartridge receiving structure such that, in the start position, the latch is positioned for engaging the locking track, rather than the unlocking track, upon a subsequent insertion of a subsequent cartridge in the cartridge receiving structure;

the cartridge further comprising an electrical circuit comprising a cartridge memory to provide cartridge characteristic data, wherein the electrical circuit extends in a plane perpendicular to the front face of the cartridge and electrodes of the memory extend along a line parallel to the front face and behind the front face;

wherein the electrical circuit is arranged behind the front face and at a top face of the cartridge, the air interface is arranged in the front face between the electrical circuit and the ink interface;

wherein, when the cartridge is oriented for connection to the cartridge receiving structure, electrodes of the electrical circuit extend vertically in a plane perpendicular to the front face, in a cut out that is open on both the front and top faces of the cartridge to connect with a connector circuit of the cartridge receiving structure within an outer circumference of the cartridge behind the front face, vertical orientation of the electrodes to establish a sideways connections with electrodes of the printer receiving structure; and wherein the cartridge has a smaller width than height when oriented for connection to the cartridge receiving structure to facilitate accommodating multiple such cartridges in the cartridge receiving structure of a scanning printhead on a scanning axis; and wherein the ink and air sockets are located on a common vertical axis on the front face, parallel to side walls of the cartridge, and in said plane perpendicular to the front face when the cartridge oriented for installation.

18. The cartridge of claim 17, wherein the ink socket is for receiving a conically shaped pen of the cartridge receiving structure, the ink socket comprising a resilient seal ring having an inner diameter arranged to stretch approximately 0.3 millimeters for forming a seal with the pen along its conical shape at insertion.

19. The cartridge of claim 18, wherein the seal ring comprises a tapering receiving mouth for aligning the pen at insertion.

20. The cartridge of claim 17, further comprising an ejector alignment interface on the front face of the cartridge.

21. The cartridge of claim 20, wherein the air interface comprises a socket, and wherein the ejector alignment interface is arranged around the socket of the air interface and has a common central axis with the socket of the air interface.

22. The cartridge of claim 20, wherein the ejector alignment interface comprises a circular ridge for engaging an inner circumference of an end of a helical spring ejector.

23. The cartridge of claim 22, wherein the circular ridge extends around the air socket and has a same central axis as the air socket.

24. The cartridge of claim 17, wherein the air socket and ejector alignment are disposed on the front face, between the ink socket and electrical circuit.

25. The cartridge of claim 17, wherein the air socket is connected to a pressure chamber in the inner volume of the cartridge.

26. The cartridge of claim 17, wherein the guide track comprises a tapered receiving opening.

27. The cartridge of claim 17, wherein the latch stop comprises a latch stop wall and a latch abutment, the abutment comprising a protrusion in the latch stop wall for keeping the latch from sliding off the latch stop wall.

28. The cartridge of claim 17, wherein the guide track and the latch track are comprised in one integral cut out in the bottom face of the cartridge.

29. An ink cartridge comprising:

interfaces for connection to a cartridge receiving structure, the interfaces being located in a front face of the cartridge in a common vertical plane that is perpendicular to the front face when the cartridge is oriented for connection to the cartridge receiving structure, the interfaces including an ink socket to provide ink to a printer, and an air socket to pressurize an inner volume of the cartridge;

a guide interface, in a bottom face of the cartridge to guide the cartridge along a straight line for connection to the cartridge receiving structure, the guide interface comprising a guide track that extends parallel to said straight line; and a latch stop and a latch track, in the bottom face of the cartridge, to guide and retain a latch of the cartridge receiving structure, wherein the latch stop comprises a latch stop wall and a latch abutment, the latch abutment comprising a protrusion in the latch stop wall for keeping the latch from sliding off the latch stop wall;

wherein the latch track comprises a locking track and a separate unlocking track, and is arranged to move the latch with respect to the latch stop along the locking track into a locked engagement position at cartridge insertion, and along the unlocking track into an unlocked position at cartridge ejection;

wherein the latch track further comprises a latch guide wall at an end of the locking track to receive the latch at the end of the locking track and to direct the latch to the latch stop;

wherein the unlocking track comprises a latch re-direct wall to receive the latch when the latch stop and the latch track are pushed inwards for ejection of the cartridge and to guide the latch out of a latch stop engagement position, past the latch abutment, and into the unlocking track for ejection of the cartridge; and the cartridge further comprising a latch guide that comprises a ramp, at a beginning of the latch track and spaced apart from the front face, that protrudes into the latch track, such that engagement with the ramp repositions the latch to a start position during ejection of the ink cartridge from the cartridge receiving structure such that, in the start position, the latch is positioned for engaging the locking track, rather than the unlocking track, upon a subsequent insertion of a subsequent cartridge in the cartridge receiving structure;

the cartridge further comprising an electrical circuit comprising a cartridge memory to provide cartridge characteristic data, wherein the electrical circuit extends in a plane perpendicular to the front face of the cartridge and electrodes of the memory extend along a line parallel to the front face and behind the front face;

wherein the electrical circuit is arranged behind the front face and at a top face of the cartridge, the air interface is arranged in the front face between the electrical circuit and the ink interface;

wherein, when the cartridge is oriented for connection to the cartridge receiving structure, electrodes of the electrical circuit extend vertically in a cut out that is open on both the front and top faces of the cartridge to connect with a connector circuit of the cartridge receiving structure within an outer circumference of the cartridge behind the front face, vertical orientation of the electrodes to establish a sideways connections with electrodes of the printer receiving structure;

wherein the cartridge has a smaller width than height when oriented for connection to the cartridge receiving structure to facilitate accommodating multiple such cartridges in the cartridge receiving structure of a scanning printhead on a scanning axis; and the cartridge further comprising an ejector alignment interface on the front face of the cartridge, wherein the ejector alignment interface comprises a circular ridge for engaging an inner circumference of an end of a helical spring ejector to align to the helical spring ejector and maintain the helical spring ejector in position when engaging the cartridge, the ridge extending around the air socket and having a same central axis as the air socket, and wherein the latch track, electrical circuit and ejector alignment interface are also in the common vertical plane.

30. The cartridge of claim 29, wherein the guide track and the latch track are comprised in one integral cut out in the bottom face of the cartridge.

* * * * *